US008070385B2

(12) United States Patent
Green

(10) Patent No.: US 8,070,385 B2
(45) Date of Patent: Dec. 6, 2011

(54) PAVING MACHINE CONTROL AND METHOD

(75) Inventor: Francisco Green, Dayton, OH (US)

(73) Assignee: Caterpillar Trimble Control Technologies, LLC, Dayton, OH (US)

( * ) Notice: Subject to any disclaimer, the term of this patent is extended or adjusted under 35 U.S.C. 154(b) by 177 days.

(21) Appl. No.: 12/176,643

(22) Filed: Jul. 21, 2008

(65) Prior Publication Data

US 2010/0014916 A1 Jan. 21, 2010

(51) Int. Cl.
*E01C 23/07* (2006.01)

(52) U.S. Cl. ..... 404/84.5; 404/118

(58) Field of Classification Search ..... 404/83–84.8, 404/114

See application file for complete search history.

(56) References Cited

U.S. PATENT DOCUMENTS

| | | | |
|---|---|---|---|
| 4,961,173 | A | 10/1990 | Sehr et al. |
| 5,258,961 | A | 11/1993 | Sehr et al. |
| 5,356,238 | A | 10/1994 | Musil et al. |
| 5,393,167 | A | 2/1995 | Fujita et al. |
| 6,027,282 | A | 2/2000 | Horn |
| 6,916,070 | B2 | 7/2005 | Sehr |
| 7,044,680 | B2 * | 5/2006 | Godbersen et al. ..... 404/75 |

FOREIGN PATENT DOCUMENTS

| | | | |
|---|---|---|---|
| DE | 10025474 | A1 | 12/2001 |
| JP | 2136405 | A | 5/1990 |

OTHER PUBLICATIONS

International Search Report and Written Opinion dated Oct. 20, 2009 pertaining to International application No. PCT/US2009/051219.

PCT International Preliminary Report on Patentability, dated Jan. 25, 2011, PCT Application No. PCT/US2009/051219, filed Jul. 21, 2009, entitled Paving Machine Control and Method, Applicant: Caterpillar Trimble Control Technologies, LLC.

* cited by examiner

*Primary Examiner* — Raymond Addie
(74) *Attorney, Agent, or Firm* — Dinsmore & Shohl LLP

(57) ABSTRACT

A control is provided for a machine that applies a material to a subgrade and pulls a floating screed over the top surface of the material behind the machine. The floating screed is attached to the machine by at least one tow arm at a tow point on the tow arm. The vertical height of the tow point is controlled by a hydraulic cylinder on the machine in response to a valve control signal applied to a hydraulic valve. The screed determines the thickness of the material on the subgrade as it is manipulated by adjusting the height of the tow point such that the top surface of the material follows a reference surface. A first sensor is mounted on the machine, adjacent the front of the machine, for sensing the relative height of the reference surface and providing a first sensor output related thereto. A second sensor for senses the height of the tow point relative to the machine and provides a second sensor output related thereto. This can be accomplished directly, or by sensing the height of the tow point with respect to the reference surface and subtracting the portion of the this sensed height attributable to changes in the reference surface. A control circuit, responsive to the first sensor output and the second sensor output, provides a valve control signal to the hydraulic valve for control of said hydraulic cylinder.

21 Claims, 2 Drawing Sheets

PAVING MACHINE CONTROL AND METHOD

CROSS-REFERENCE TO RELATED APPLICATION

Not applicable.

STATEMENT REGARDING FEDERALLY SPONSORED RESEARCH OR DEVELOPMENT

Not applicable.

BACKGROUND OF THE INVENTION

This relates to an improved control and control method for a paving machine and, more particularly, to such a control and control method for paving machines that utilized floating screeds for contouring the surface of the paved area to match adjacent, reference surfaces such as adjacent paved areas, adjacent curbs, and adjacent string lines that extend between surveyor located stakes.

Paving machines of this type typically include a tractor or towing vehicle that moves along a subgrade to be paved. The paving machine deposits a layer of asphalt or other paving material on the subgrade, and the thickness and contour of the asphalt layer are determined by a floating screed that is towed behind the vehicle. The screed has a plate that rides over the surface of the asphalt behind the vehicle, and a pair of forward extending tow arms. The tow arms are connected to the vehicle at tow points which can be raised and lowered by hydraulic cylinders. When the tow points are raised, the front edge of the screed plate is raised and the orientation of the plate is such that it tends to plane upward over the asphalt that is being deposited on the subgrade just ahead of the screed, raising the top surface of the asphalt layer. Conversely, when the tow points are lowered, the front edge of the screed plate is also lowered, reorienting the plate to plane downward, and lowering the top surface of the asphalt layer. It will be appreciated, that the screed smoothes the top surface of the layer of the paving material, while at the same time controlling the vertical position of this surface.

The paving machine deposits the paving material on the subgrade so that the top surface of the paving material follows a desired elevation contour. For example, when a second strip of asphalt is deposited on a roadbed next to a first strip of asphalt, it is desired that the surface height of the two strips match precisely at the seam where they abut. As another example, when an asphalt layer is deposited on a subgrade next to an existing street curb, it may be desired that the asphalt surface height be controlled precisely with respect to the curb. As a further example, a surveyor may have previously surveyed a road or other surface to be paved and set a series of stakes with a reference string line running from the top of one stake to the top of the next stake. In each instance, it is necessary that the vertical position of the top surface of the deposited paving material be controlled precisely with respect to a reference surface of some sort, and this requires that the tow points of the tow arms be controlled with precision.

Prior art paving machines have used a number of approaches to controlling the screed. It has been common to attach a horizontal bar to the tow point so that the bar extends parallel to the direction of movement of the paving machine and laterally displaced to the side of the machine. The bar is mechanically constrained in a horizontal position and has a number of downward facing ultrasonic sensors mounted along its length. The sensors determine the distances to the reference surface at measurement points directly beneath them. These distances can then be used to control the raising and lowering of the tow point. The tow point on the opposite side of the machine may be raised and lowered by the same amount, or it may be controlled independently using a second horizontal bar and a second set of ultrasonic sensors.

Such prior art control arrangements for paving machines are cumbersome, difficult to transport, and easily damaged. An improved control and method are needed for paving machines having fewer sensors and less cumbersome mounting arrangements, and providing effective control of the screed.

SUMMARY OF THE INVENTION

These needs are met by a control for a machine that applies a material to a subgrade and pulls a floating screed over the top surface of the material behind the machine. The floating screed is attached to the machine by at least one tow arm at a tow point on the tow arm. The vertical height of the tow point is controlled by a hydraulic cylinder on the machine in response to a valve control signal applied to a hydraulic valve. The screed determining the thickness of the material on the subgrade and is manipulated by adjusting the height of the tow point such that the top surface of the material follows a reference surface. The control includes a first sensor mounted on the machine, adjacent the front of the machine, for sensing the relative height of the reference surface and providing a first sensor output related thereto. The control includes a second sensor for sensing the height of the tow point relative to the reference surface and for providing a second sensor output related thereto. Finally, the control includes a control circuit, responsive to the first sensor output and the second sensor output, for providing a valve control signal to the hydraulic valve for control of the hydraulic cylinder.

The control circuit may be further responsive to an operator selected set-point value. The control circuit may comprises a memory for storing a plurality of first sensor outputs taken over a period of time, a circuit for averaging the plurality of first sensor outputs to provide an averaged first sensor output, a circuit for subtracting one of the first sensor outputs stored in the memory from the second sensor output to provide a difference signal indicative of the position of the second sensor with respect to the machine, a circuit for adding the averaged first sensor output and the difference signal to provide a control signal, and a comparator for comparing the control signal to an operator selected set point value to provide a valve control signal to the hydraulic valve for control of the hydraulic cylinder. The circuit for subtracting one of the first sensor outputs stored in the memory from the second sensor output to provide a difference signal indicative of the position of the second sensor with respect to the machine may comprises a circuit which subtracts a first sensor output stored in memory at a point in time that is earlier by an amount equal to the distance between the first sensor and the second sensor divided by the velocity of the machine moving along the subgrade.

The first sensor may comprise an ultrasonic sensor mounted on the machine, adjacent the front of the machine, for sensing the relative height of the reference surface. The second sensor may comprise an ultrasonic sensor for sensing the height of the tow point relative to the reference surface. The control circuit may comprise a filter for filtering the first sensor output to provide a filtered first sensor output, a circuit for subtracting a first sensor output from a prior measurement time from the second sensor output to provide a difference signal indicative of the position of the second sensor with respect to the machine, a circuit for adding the filtered first sensor output and the difference signal to provide a control signal, and a comparator for comparing the control signal to an operator selected set point value to provide a valve control signal to the hydraulic valve for control of the hydraulic cylinder. The filter may comprise a memory for storing a plurality of first sensor outputs taken over a period of time, and a circuit for averaging the plurality of first sensor outputs to provide a filtered first sensor output. The circuit for averaging the plurality of first sensor outputs to provide a filtered first sensor output may comprise a circuit that divides the sum of the stored first sensor outputs by the number of first sensor outputs making up the sum.

The control may comprise a first sensor mounted on the machine, adjacent the front of the machine, for sensing the relative height of the reference surface and providing a first sensor output related thereto, a second sensor for sensing the height of the tow point relative to the machine and providing a second sensor output related thereto, and a control circuit, responsive to the first sensor output and the second sensor output, for providing a valve control signal to the hydraulic valve for control of the hydraulic cylinder. The control circuit may be further responsive to an operator selected set-point value, and may comprise a memory for storing a plurality of first sensor outputs taken over a period of time, a circuit for averaging the plurality of first sensor outputs to provide an averaged first sensor output, a circuit for adding the averaged first sensor output and the second sensor output to provide a control signal, and a comparator for comparing the control signal to an operator selected set point value to provide a valve control signal to the hydraulic valve for control of the hydraulic cylinder. The first sensor may comprise an ultrasonic sensor mounted on the machine, adjacent the front of the machine, for sensing the relative height of the reference surface. The control circuit may comprise a filter for filtering the first sensor output to provide a filtered first sensor output, a circuit for adding the filtered first sensor output and the second sensor output to provide a control signal, and a comparator for comparing the control signal to an operator selected set point value to provide a valve control signal to the hydraulic valve for control of the hydraulic cylinder. The filter may comprise a memory for storing a plurality of first sensor outputs taken over a period of time, and a circuit for averaging the plurality of first sensor outputs to provide a filtered first sensor output. The circuit for averaging the plurality of first sensor outputs to provide a filtered first sensor output may comprise a circuit that divides the sum of the stored first sensor outputs by the number of first sensor outputs making up the sum.

A method of controlling such a machine that applies a material to a subgrade and pulls a floating screed over the top surface of the material behind the machine, may include the steps of sensing the height of the reference surface with respect to the machine adjacent the front of the machine and providing a first sensor output related thereto, sensing the height of the tow point with respect to the reference surface and providing a second sensor output related thereto, and providing a valve control signal to the hydraulic valve for control of the hydraulic cylinder in response to the first and second sensor outputs. The valve control signal may also be provided in response to an operator selected set point. The method may utilize a second sensor output based on the height of the tow point with respect to the machine.

Accordingly, it is an object to provide an improved control and control method for controlling a machine of the type that pulls a floating screed.

DETAILED DESCRIPTION OF THE PREFERRED EMBODIMENTS

Figure 1:
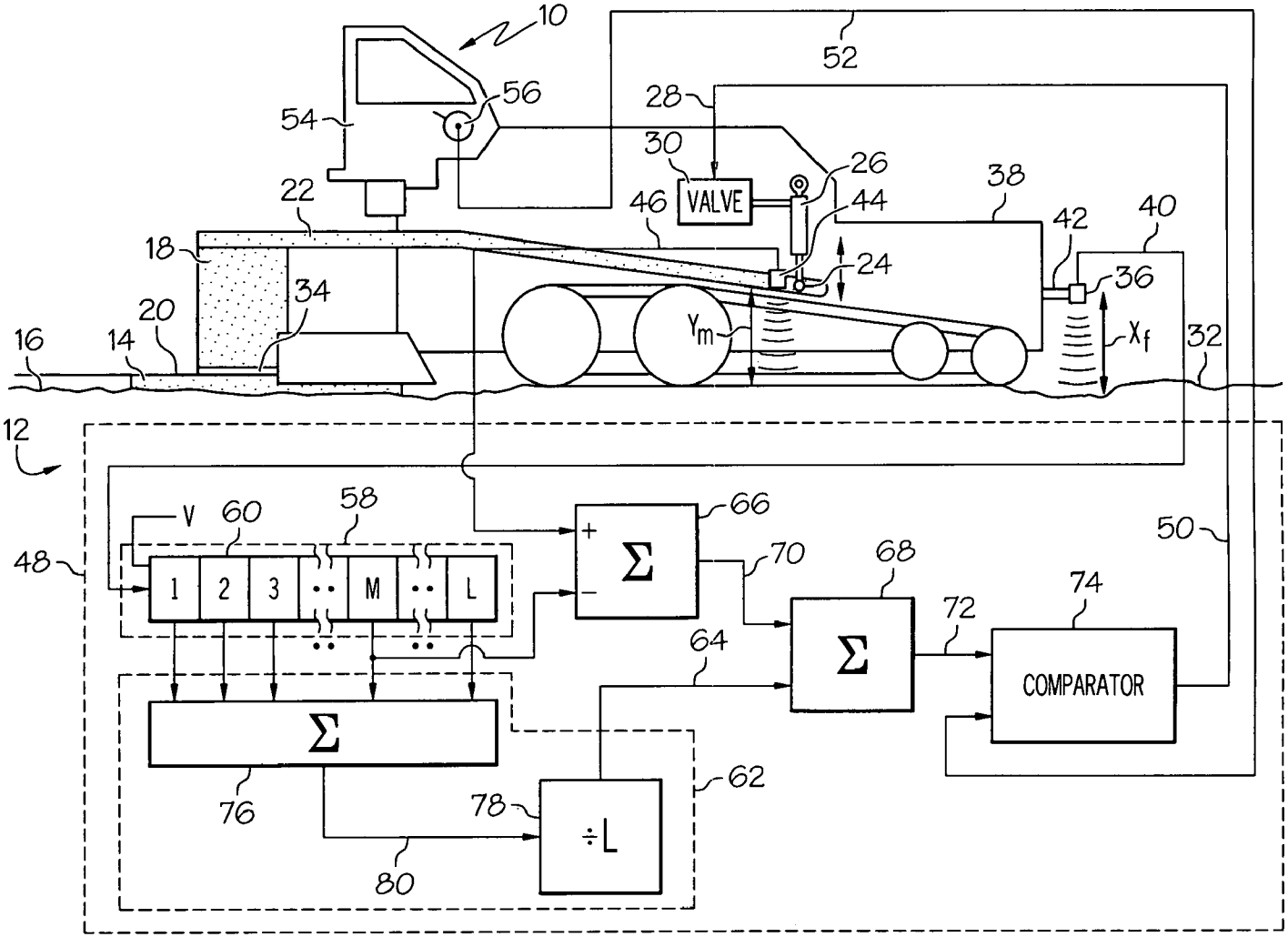
FIG. 1 is a diagrammatic representation of a paving machine and a first embodiment of a control therefore.

FIG. 1 is a diagrammatic representation of a paving machine 10 and a control 12 for the machine. The machine 10 applies a material 14, such as asphalt, to a subgrade 16, and pulls a floating screed 18 over the top surface 20 of the material 14 behind the machine 10. The floating screed 18 is attached to the machine by at least one tow arm 22 at a tow point 24 on the tow arm. The vertical height of the tow point 24 is controlled by a hydraulic cylinder 26 on the machine 10 in response to a valve control signal on line 28 applied to a hydraulic valve 30. The screed 18 screed determines the thickness of the material 14 on the subgrade 16 and is being manipulated by adjusting the height of the tow point 24 such that the top surface 20 of the material 14 follows a reference surface 32. Surface 32 is a reference that is adjacent the paving machine, to the side of the paving machine closest to the viewer in FIG. 1, and may be the surface of the ground adjacent to the paving machine 10.

The method by which a screed 18 is operated to control the height of the upper surface 20 of the paving material 14 is well known. The paving material 14 is deposited on the subgrade 16 at the rear of the machine 10 as the machine travels along the subgrade. The screed 18 is pulled by a pair of arms 22, only one of which is illustrated in FIG. 1, with arms 22 extending forward from the rear of the machine 10 and engaged at a pair of tow points 24. When the tow points 24 are raised, the screed plate 34 is tilted with the front edge of the plate 34 higher than the rear edge. In this orientation, the screed 18 tends to plane upward over the paving material being deposited on the subgrade 16 from the rear of the machine 10. The result is that the top surface 20 of the material is raised. When the tow points 24 are lowered, the screed plate 34 is tilted with the front edge of the plate 34 lower than the rear edge. In this orientation, the screed 18 tends to plane downward over the paving material being deposited on the subgrade 16 from the rear of the machine. The result is that the top surface 20 of the material is lowered. Hydraulic cylinder 26 may be operated in parallel with an identical hydraulic cylinder (not shown) on the other side of the machine, or the cylinders may be controlled and operated independently.

The control 12 includes a first sensor 36 mounted on the machine 10, adjacent the front 38 of the machine 10 and to the side of the path of the machine 10, for sensing the relative height $X_f$ of the reference surface 32 and for providing a first sensor output on line 40 related thereto. The sensor 36 is preferably an ultrasonic sensor that is mounted on a support bracket 42 adjacent and forward of the front of the machine 10. The sensor 36 extends to the side of the machine 10 so that it is over the reference surface 32. Sensor 36 directs a pulsed sound beam downward and determines the distance to the reference surface, $X_f$, based on the time required for sound pulses to travel to the reference surface, and then be reflected and return to the sensor 36. The control includes a second sensor 44, also preferably an ultrasonic sensor, that senses the height $Y_m$ of the tow point 24 relative to the reference surface 32, and provides a second sensor output on line 46 related thereto. Finally, the control 12 includes a control circuit 48 that is responsive to the first sensor output on line 40 and to the second sensor output on line 46. The control circuit 48 provides a valve control signal on line 50 to the hydraulic valve 30 to control the hydraulic cylinder 26. As will become apparent, the control circuit 48 is also responsive to an operator selected set-point value one line 52 that a paving machine operator in cab 54 can adjust with manual control 56 so that the height of the surface 20 of the asphalt matches a desired level. Once the appropriate set point is selected by the operator, the control will automatically follow the reference surface 32 up and down, and maintain this match of the height of the surface 20 to the desired surface height. It will be appreciated that, if desired, the set-point value 52 may be automatically generated by a control circuit including a position sensor, such as a GPS receiver system, which bases the set point of the system on the position in three dimensions of the machine 10.

The ultrasonic sensor 44 is mounted on the arm 22 so that it moves with the tow point 24, and provides cylinder feedback for the control. The ultrasonic sensor 36 is mounted so that it is fixed to the machine 10 and does not move vertically with the tow point. Transducer 36 provides a history of the surface 32 that does not change its reference when the tow point cylinder 26 is adjusted. The transducer 36 provides the values of that can be averaged for determination of the desired surface. Assume that the measurements of the tow point transducers are denoted by $Y_m$. Note that $Y_m$ changes as the machine moves forward due to movements in the tow point cylinder 26 and also due to variations in the reference surface 32 passing beneath the transducer 44. Assume that $X_f$ denotes the measurements of the surface taken by the transducer 36. It will be appreciated that $X_f$ changes only as a function of the variation of the reference surface. Assuming that $Y_m$ and $X_f$ are measured along the same path, and assuming further that we know both the distance between their measurements and the forward speed of the machine V, we can estimate the variations due to the surface at the point of measurement for $Y_m$. We will call this surface estimate $X_m$. We can then create a signal $Y'_m$ which changes primarily with movements of the tow point cylinder 26:

$$Y'_m = Y_m - X_m.$$

However, the control feedback must have some reference that depends on surface measurement. In a prior art averaging system using three sensors on a horizontal bar, this reference was:

$$Y^{ref}_{average} = (Y_f + Y_m + Y_b)/3$$

where $Y_f$, $Y_m$, and $Y_b$ are the front, middle and back, ultrasonic measurements, respectively. Having a history of surface measurements on a fixed frame, we can determine a similar estimate by averaging the back, middle, and front values of our surface window. A better reference might be to average all the measurements over the desired length:

$$\begin{aligned} X^{ref}_{average} &= \text{average of all values over desired length,} \\ &= \text{average of front, middle, and back values over desired length,} \\ &= \text{some smoothing filter calculation over space for measurements over the desired length.} \end{aligned}$$

Our control servo control signal then becomes:

$$Y_{control} = Y_m - X_m + X^{ref}_{average}$$

An additional advantage of this technique is that the length of the surface, and the type of smoothing filter applied to it, can be made selectable.

The control circuit 48 includes a memory 58, shown as a shift register 60, for storing a plurality of first sensor outputs taken over a period of time. The shift register 60 is capable of storing L sensor outputs. It will be appreciated, however, that other memory arrangements may be used which store the first sensor outputs and the times at which those outputs were stored. The control circuit 48 further includes a circuit 62 for averaging the plurality of first sensor outputs to provide an averaged first sensor output on line 64. The control circuit 48 has a circuit 66 for subtracting one of the first sensor outputs stored in the memory, shown as the output stored in memory location M, from the second sensor output on line 46 to provide a difference signal indicative of the position of the second sensor 44 with respect to the machine 10. A circuit 68 adds the averaged first sensor output on line 64 and the difference signal on line 70 to provide a control signal on line 72. Finally, a comparator 74 compares the control signal on line 72 to an operator selected set point value on line 52 to provide a valve control signal on line 50 to the hydraulic valve 30 for control of the hydraulic cylinder 26. The circuit 66 for subtracting one of the first sensor outputs, M, stored in the memory 58 from the second sensor output on line 46 to provide a difference signal on line 70 indicative of the position of the second sensor 44 with respect to the machine 10 comprises a circuit which subtracts a first sensor output stored in memory earlier in time by an amount equal to the distance between the first sensor and the second sensor divided by the velocity of the machine V along the subgrade. It is apparent that this stored first sensor output reflects the portion of the distance $Y_m$ then being measured that is attributable to the $X_f$ value that was previously measured. In the control circuit 48 in FIG. 1, this is effected by stepping the shift register 60 at a rate V which is related to the velocity of the machine 10 so that the sensor output stored in register position M reflects the value $X_f$ that was taken at a point on the reference surface 32 which is then directly below the sensor 44. As stated previously, the balance of the value $Y_m$ then being measured is attributable to the position of the tow point 24 and sensor 44 with respect to the body of the machine 10. By subtracting the previously taken value $X_f$ from the current value $Y_m$, this is determined.

It will be appreciated that the shift register 60 and summing circuit 76 together constitute a filter circuit, which effectively smoothes the output on line 40 of the first sensor 36. Divider circuit 78 divides the output of the filter on line 80, providing an averaged first sensor output. It will also be appreciated that each of the stored values in the shift register 60 may be divided by the value L, the number of such values, before summing the values in adder 76, rather than after these values are summed, as illustrated in FIG. 1.

It will be appreciated by those skilled in the art that another form of smoothing filter could be applied instead of an averaging filter. It will be appreciated by those skilled in the art that other forms of elevation sensors could be used instead of the sonic sensors described in the above embodiment.

Figure 2:
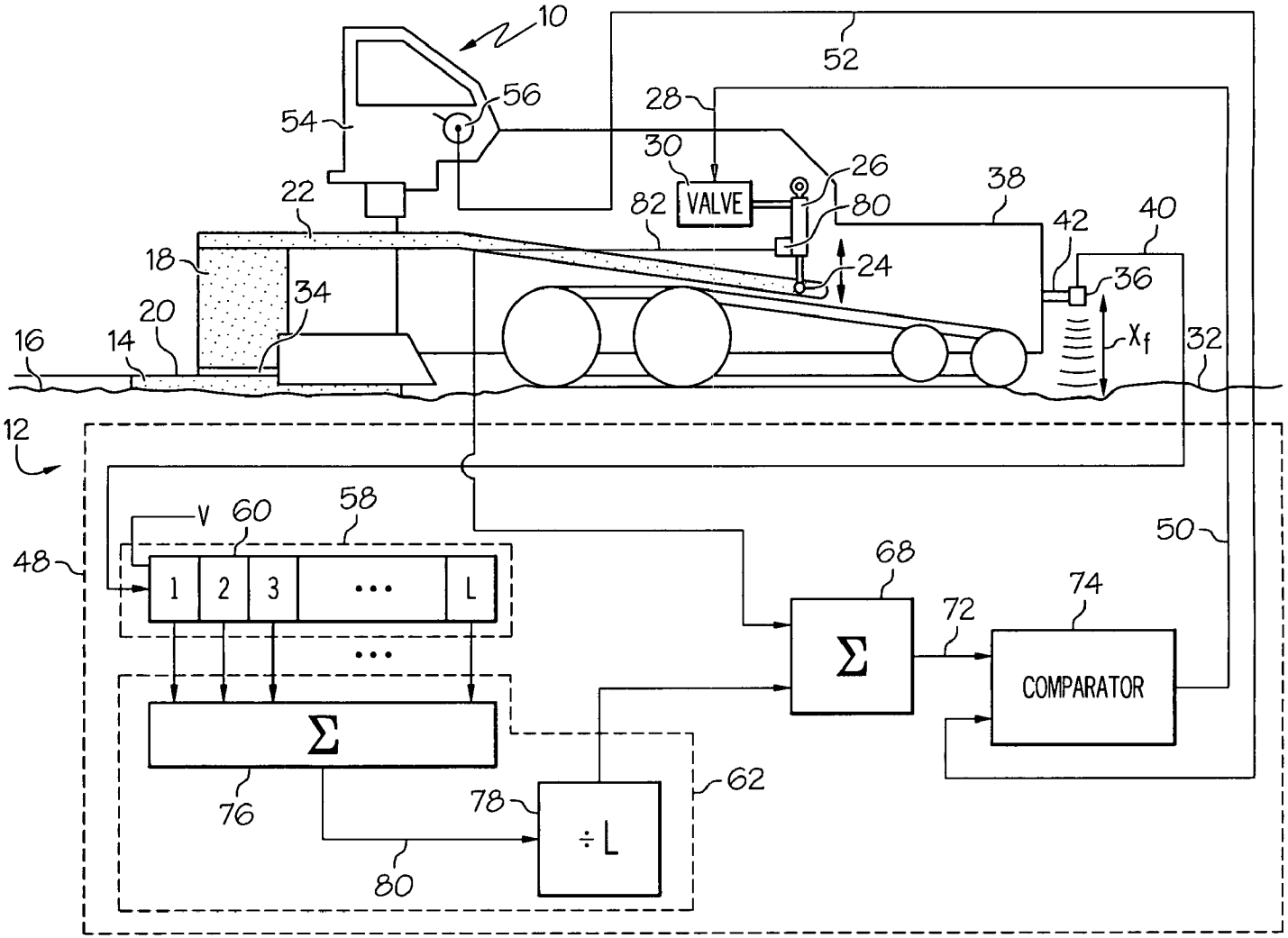
FIG. 2 is a diagrammatic representation of a paving machine and a second embodiment of a control therefore.

The second embodiment is illustrated in FIG. 2, in which corresponding elements are indicated with the same reference numerals as used for those elements in FIG. 1. The second embodiment differs from the first in the manner in which a signal is separately developed, tracking the movement of the tow point 24 with respect to the machine 10. Whereas in the first embodiment a sensor determined the distance from the tow point to the reference surface and the portion of that attributable to changes in the reference surface was subtracted, in this embodiment, a second sensor 80 senses the height of the tow point 24 relative to the machine directly by monitoring extension of the hydraulic cylinder 26 directly and providing a second sensor output on line 82 directly related thereto. Various types of sensors may be used for sensor 80, such as for example a string sensor may be used to monitor the extension and retraction of the piston in hydraulic cylinder 26 which is directly related to the lowering and raising of the tow point 24 with respect to the machine 10.

Other aspects can be obtained from a study of the drawings, the disclosure, and the appended claims.

What is claimed is:

1. A control for a machine that applies a material to a subgrade and pulls a floating screed over the top surface of the material behind the machine, said floating screed being attached to the machine by at least one tow arm at a tow point on said tow arm, the vertical height of said tow point being controlled by a hydraulic cylinder on said machine in response to a valve control signal applied to a hydraulic valve, said screed determining the thickness of the material on the subgrade and being manipulated by adjusting the height of said tow point such that the top surface of the material follows a reference surface, comprising:

a first sensor mounted on the machine, adjacent the front of the machine, for sensing the relative height of the reference surface and providing a first sensor output related thereto, a second sensor, mounted on said at least one tow arm adjacent said tow point, for sensing the height of the tow point relative to the reference surface and providing a second sensor output related thereto, a control circuit, responsive to said first sensor output and said second sensor output, for providing a valve control signal to said hydraulic valve for control of said hydraulic cylinder.

2. The control for a machine that applies a material to a subgrade and pulls a floating screed over the top surface of the material behind the machine according to claim 1, in which said control circuit is further responsive to an operator selected set-point value.

3. The control for a machine that applies a material to a subgrade and pulls a floating screed over the top surface of the material behind the machine according to claim 1, in which said control circuit is further responsive to an automatically selected set-point value based on positional information.

4. The control for a machine that applies a material to a subgrade and pulls a floating screed over the top surface of the material behind the machine according to claim 1, in which said control circuit comprises:

a memory for storing a plurality of first sensor outputs taken over a period of time, a circuit for averaging the plurality of first sensor outputs to provide an averaged first sensor output, a circuit for subtracting one of said first sensor outputs stored in said memory from said second sensor output to provide a difference signal indicative of the position of said second sensor with respect to said machine, a circuit for adding said averaged first sensor output and said difference signal to provide a control signal, and a comparator for comparing said control signal to an operator selected set point value to provide a valve control signal to said hydraulic valve for control of said hydraulic cylinder.

5. The control for a machine that applies a material to a subgrade and pulls a floating screed over the top surface of the material behind the machine according to claim 4, in which said circuit for subtracting one of said first sensor outputs stored in said memory from said second sensor output to provide a difference signal indicative of the position of said second sensor with respect to said machine comprises a circuit which subtracts a first sensor output stored in memory earlier in time by an amount equal to the distance between said first sensor and said second sensor divided by the velocity of said machine along said subgrade.

6. The control for a machine that applies a material to a subgrade and pulls a floating screed over the top surface of the material behind the machine according to claim 1, in which said first sensor comprises an ultrasonic sensor mounted on the machine, adjacent the front of the machine, for sensing the relative height of the reference surface.

7. The control for a machine that applies a material to a subgrade and pulls a floating screed over the top surface of the material behind the machine according to claim 1, in which said second sensor comprises an ultrasonic sensor for sensing the height of the tow point relative to the reference surface.

8. The control for a machine that applies a material to a subgrade and pulls a floating screed over the top surface of the material behind the machine according to claim 1, in which said control circuit comprises:

a filter for filtering the said first sensor output to provide a filtered first sensor output, a circuit for subtracting a first sensor output from a prior measurement time from said second sensor output to provide a difference signal indicative of the position of said second sensor with respect to said machine, a circuit for adding said filtered first sensor output and said difference signal to provide a control signal, and a comparator for comparing said control signal to an operator selected set point value to provide a valve control signal to said hydraulic valve for control of said hydraulic cylinder.

9. The control for a machine that applies a material to a subgrade and pulls a floating screed over the top surface of the material behind the machine according to claim 8, in which said filter comprises a memory for storing a plurality of first sensor outputs taken over a period of time, and a circuit for averaging the plurality of first sensor outputs to provide a filtered first sensor output.

10. The control for a machine that applies a material to a subgrade and pulls a floating screed over the top surface of the material behind the machine according to claim 9, in which said circuit for averaging the plurality of first sensor outputs to provide a filtered first sensor output comprises a circuit that divides the sum of the stored first sensor outputs by the number of first sensor outputs making up said sum.

11. A control for a machine that applies a material to a subgrade and pulls a floating screed over the top surface of the material behind the machine, said floating screed being attached to the machine by at least one tow arm at a tow point on said tow arm, the vertical height of said tow point being controlled by a hydraulic cylinder on said machine in response to a valve control signal applied to a hydraulic valve, said screed determining the thickness of the material on the subgrade and being manipulated by adjusting the height of said tow point such that the top surface of the material follows a reference surface, comprising:

a first sensor mounted on the machine, adjacent the front of the machine, for sensing the relative height of the reference surface and providing a first sensor output related thereto, a second sensor for sensing the height of the tow point relative to the machine and providing a second sensor output related thereto, and a control circuit, responsive to said first sensor output and said second sensor output, for providing a valve control signal to said hydraulic valve for control of said hydraulic cylinder.

12. The control for a machine that applies a material to a subgrade and pulls a floating screed over the top surface of the material behind the machine according to claim 11, in which said control circuit is further responsive to an operator selected set-point value.

13. The control for a machine that applies a material to a subgrade and pulls a floating screed over the top surface of the material behind the machine according to claim 11, in which said control circuit comprises:

a memory for storing a plurality of first sensor outputs taken over a period of time, a circuit for averaging the plurality of first sensor outputs to provide an averaged first sensor output, a circuit for adding said averaged first sensor output and said second sensor output to provide a control signal, and a comparator for comparing said control signal to an operator selected set point value to provide a valve control signal to said hydraulic valve for control of said hydraulic cylinder.

14. The control for a machine that applies a material to a subgrade and pulls a floating screed over the top surface of the material behind the machine according to claim 11, in which said first sensor comprises an ultrasonic sensor mounted on the machine, adjacent the front of the machine, for sensing the relative height of the reference surface.

15. The control for a machine that applies a material to a subgrade and pulls a floating screed over the top surface of the material behind the machine according to claim 11, in which said control circuit comprises:

a filter for filtering the said first sensor output to provide a filtered first sensor output, a circuit for adding said filtered first sensor output and said second sensor output to provide a control signal, and a comparator for comparing said control signal to an operator selected set point value to provide a valve control signal to said hydraulic valve for control of said hydraulic cylinder.

16. The control for a machine that applies a material to a subgrade and pulls a floating screed over the top surface of the material behind the machine according to claim 15, in which said filter comprises a memory for storing a plurality of first sensor outputs taken over a period of time, and a circuit for averaging the plurality of first sensor outputs to provide a filtered first sensor output.

17. The control for a machine that applies a material to a subgrade and pulls a floating screed over the top surface of the material behind the machine according to claim 16, in which said circuit for averaging the plurality of first sensor outputs to provide a filtered first sensor output comprises a circuit that divides the sum of the stored first sensor outputs by the number of first sensor outputs making up said sum.

18. A method of controlling a machine that applies a material to a subgrade and pulls a floating screed over the top surface of the material behind the machine, said floating screed being attached to the machine by at least one tow arm at a tow point on said tow arm, the vertical height of said tow point being controlled by a hydraulic cylinder on said machine in response to a valve control signal applied to a hydraulic valve, said screed determining the thickness of the material on the subgrade and being manipulated by adjusting the height of said tow point such that the top surface of the material follows a reference surface, comprising the steps of:

sensing the height of the reference surface with respect to the machine adjacent the front of the machine and providing a first sensor output related thereto, sensing the height of the tow point with respect to the reference surface and providing a second sensor output related thereto, and providing a valve control signal to the hydraulic valve for control of the hydraulic cylinder in response to the first and second sensor outputs.

19. The method of claim 18 in which the step of providing a valve control signal to the hydraulic valve for control of the hydraulic cylinder in response to the first and second sensor outputs further includes the step of providing a valve control signal to the hydraulic valve for control of the hydraulic cylinder in response to the first and second sensor outputs and an operator selected set-point value.

20. A method of controlling a machine that applies a material to a subgrade and pulls a floating screed over the top surface of the material behind the machine, said floating screed being attached to the machine by at least one tow arm at a tow point on said tow arm, the vertical height of said tow point being controlled by a hydraulic cylinder on said machine in response to a valve control signal applied to a hydraulic valve, said screed determining the thickness of the material on the subgrade and being manipulated by adjusting the height of said tow point such that the top surface of the material follows a reference surface, comprising the steps of:

sensing the height of the reference surface with respect to the machine adjacent the front of the machine and providing a first sensor output related thereto, sensing the height of the tow point with respect to the machine and providing a second sensor output related thereto, and providing a valve control signal to the hydraulic valve for control of the hydraulic cylinder in response to the first and second sensor outputs.

21. The method of claim 20 in which the step of providing a valve control signal to the hydraulic valve for control of the hydraulic cylinder in response to the first and second sensor outputs further includes the step of providing a valve control signal to the hydraulic valve for control of the hydraulic cylinder in response to the first and second sensor outputs and an operator selected set-point value.

* * * * *